United States Patent [19]

Steinmeier

[11] 4,176,340

[45] Nov. 27, 1979

[54] SHOCK-RESPONSIVE ACTIVATING DEVICE FOR EMERGENCY FLASHER SYSTEMS OF AUTOMATIVE VEHICLES

[76] Inventor: Albert Steinmeier, Ringweg 7, D-7972 Isny-Neutrauchburg, Fed. Rep. of Germany

[21] Appl. No.: 877,472

[22] Filed: Feb. 13, 1978

[30] Foreign Application Priority Data

Feb. 18, 1977 [DE] Fed. Rep. of Germany ..... 2706962

[51] Int. Cl.[2] ..... G08B 21/00

[52] U.S. Cl. ..... 340/52 H; 340/61; 200/61.45 M; 180/282

[58] Field of Search ..... 340/52 H, 61, 71, 669; 200/61.45 R, 61.45 M; 180/103, 104

[56] References Cited

U.S. PATENT DOCUMENTS

| | | | |
|---|---|---|---|
| 3,251,033 | 5/1966 | Lawyer | 340/52 H |
| 3,720,915 | 3/1973 | Hass | 340/52 H |
| 3,840,088 | 10/1974 | Marumo et al. | 340/52 H |

*Primary Examiner*—Alvin H. Waring
*Attorney, Agent, or Firm*—Peter K. Kontler

[57] ABSTRACT

A device which automatically completes the circuit of the emergency flasher system in an automotive vehicle in response to a shock of predetermined magnitude (such shocks develop as a result of sudden application of brakes or in the event of an accident) has an upright cylindrical housing which is secured to the vehicle and contains a normally open multi-pole switch whose closing results in activation of the flasher system. The multi-pole switch can be closed by the plunger of a relay whose coil is in circuit with a normally open second switch adapted to be closed on tilting of an activating element having a permanent magnet which normally adheres to an iron plate in the housing but allows the activating element to change its position in response to the application of a shock. The tilted activating element effects the displacement of a post which temporarily closes the second switch to energize the coil which causes the plunger to close the multi-pole switch. The closed multi-pole switch completes a holding circuit for the relay. Such holding circuit can be opened by a normally closed manually operable switch. A normally open switch is connected in parallel with the second switch to activate the flasher system at the will of the operator.

9 Claims, 5 Drawing Figures

SHOCK-RESPONSIVE ACTIVATING DEVICE FOR EMERGENCY FLASHER SYSTEMS OF AUTOMATIVE VEHICLES

BACKGROUND OF THE INVENTION

The present invention relates to flasher systems of automotive vehicles, and more particularly to improvements in means for automatically activating such flasher systems in the event of an emergency. Still more particularly, the invention relates to improvements in shock-responsive activating means for emergency flasher systems.

German Pat. No. 2,412,807 discloses a shock-responsive activating switch arrangement for emergency flasher systems. The switch arrangement is responsive to abrupt changes in the speed of the automotive vehicle and comprises a high-inertia activating element which constitutes a permanent magnet and is loosely supported by and attracted to an iron plate. The activating element can displace or effects the displacement of a pin-shaped trip which extends through a hole of the iron plate and is displaced in response to tilting of the actuating element to thereby complete the circuit of the emergency flasher system. The housing for the iron plate, activating element and the switch which can complete the circuit of the flasher system is fixedly mounted in the automotive vehicle, and the activating element is tilted in response to an abrupt shock such as develops in the course of an accident, as a result of sudden application of brakes and in analogous situations. The magnitude of the shock which triggers the activation of emergency flasher system is selected in such a way that one can anticipate the inability of the operator to manually activate the flasher system. For example, a dazed or injured operator might be unable to activate the flasher system when the operator is involved in or attempts to avoid an accident. On the other hand, the activation of flasher system under such circumstances is likely to prevent or reduce the possibility of more serious or additional accidents because the activated flasher system warns the drivers of other vehicles that the vehicle whose flasher system is on requires careful attention.

A drawback of the patented activating arrangement is that it is complex and expensive as well as that its mounting in a vehicle necessitates substantial and costly modifications of existing emergency flasher systems.

OBJECTS AND SUMMARY OF THE INVENTION

An object of the invention is to provide a simple, compact and rugged activating device which can be combined with existing emergency flasher systems for automotive vehicles to activate the associated flasher system in the event of an emergency, such as on sudden application of brakes or during an accident.

Another object of the invention is to provide an activating device which insures automatic activation of the flasher system in response to a shock of selected magnitude.

A further object of the invention is to provide an activating device which can be associated with a flasher system without necessitating extensive and costly alterations in the design and/or mounting of the flasher system.

An additional object of the invention is to provide an activating device which does not prevent the operator of the vehicle from activating the flasher system in other than emergency situations.

Still another object of the invention is to provide a novel and improved arrangement of switches and relay means which form part of the above outlined activating device.

An ancillary object of the invention is to provide an activating device which is sufficiently compact to be installed in any one of a large number of available spaces in an automotive vehicle.

The invention is embodied in the combination of an emergency flasher system which is installed in an automotive vehicle and comprises electric circuit means arranged to furnish a series of signals in response to completion of the circuit means (the signals can be furnished by the conventional left-turn and right-turn lamps of the vehicle), with a shock-responsive activating device including (a) a preferably upright and preferably cylindrical housing which is secured to the frame of the automotive vehicle, (b) a normally open circuit-completing first switch (preferably a multi-pole switch) in the housing, (c) a ferromagnetic carrier (such as an iron plate) in the housing, (d) a tiltable activating element which includes or constitutes a permanent magnet normally adhering to the ferromagnetic carrier but permitting temporary tilting of the activating element in response to the application of a shock of predetermined magnitude, (e) a normally open second switch in the housing, (f) a relay installed in the housing and including a coil in circuit with the second switch so that the coil is energized on closing of the second switch and a plunger which is displaceable on energization of the coil to thereby close the first switch and to thus complete the circuit means of the flasher system, (g) an elongated pin or post or analogous movable means for closing the second switch in response to tilting of the activating element to thereby energize the coil of the relay, and (h) a holding circuit for the relay.

The first switch includes means for completing the holding circuit for the relay on closing of the first switch by the plunger.

The aforementioned pin or post which constitutes the closing means for the second switch preferably extends through a central opening of the carrier and through a central passage of the core of a spool for the coil of the relay. Furthermore, the activating device preferably comprises a spring or other suitable means for biasing the plunger of the relay to a position in which the first switch is permitted to open when the coil is deenergized. The fixed contacts of the first switch are mounted in the housing, and the movable contacts of the first switch are mounted on the plunger. The second switch has a fixed contact which is mounted on an insulating support for the fixed contacts of the first switch, and a second contact which is preferably elastic and engages the first contact of the second switch when the closing pin or post is displaced (preferably by the second contact of the second switch) on tilting of the activating element.

The novel features which are considered as characteristic of the invention are set forth in particular in the appended claims. The improved activating device itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
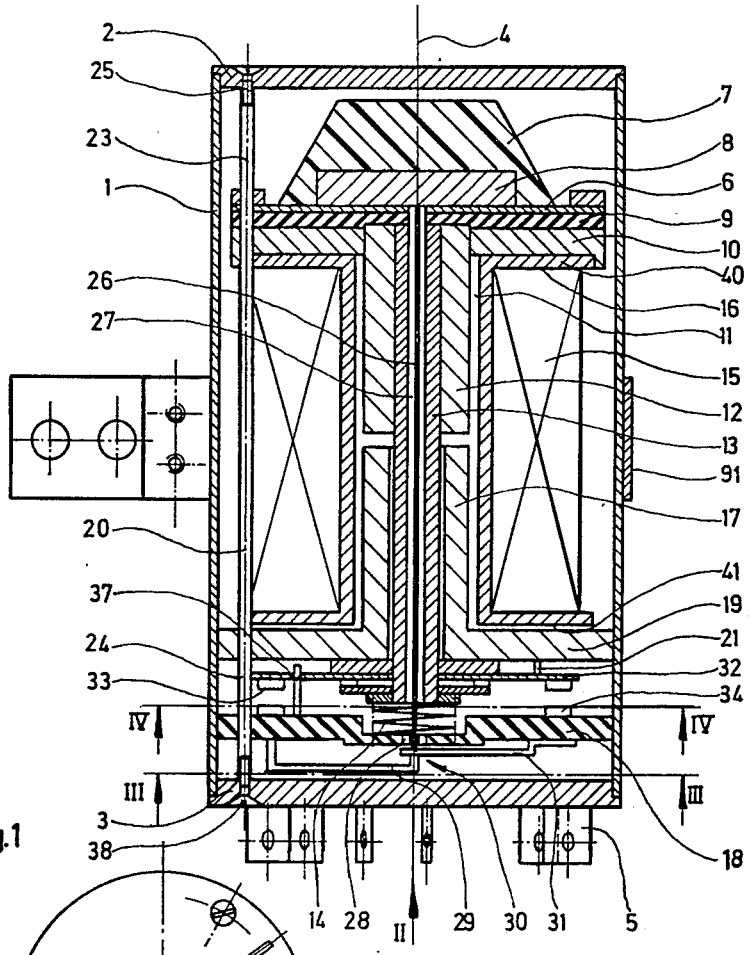
FIG. 1 is an axial sectional view of an activating device which embodies the invention.
Figure 2:
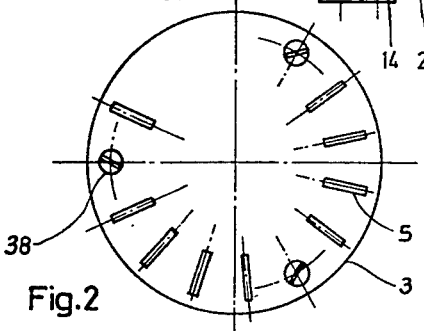
FIG. 2 is a bottom plan view of the activating device as seen in the direction of arrow II in FIG. 1.
Figure 3:
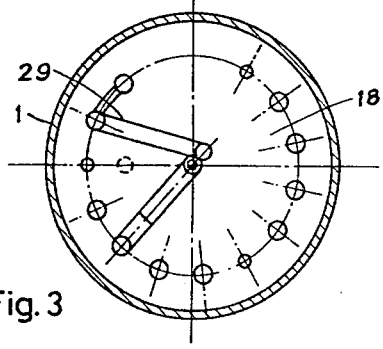
FIG. 3 is a transverse sectional view as seen in the direction of arrows from the line III-III of FIG. 1.

Referring first to FIG. 1, there is shown a shock responsive activating device which comprises a housing including an upright cylindrical shell 1, an upper end wall or cover plate 2 and a lower end wall or bottom plate 3. The reference character 4 denotes the vertical symmetry axis of the housing which latter is mounted in the automotive vehicle in upright position. The housing is held in upright position by male contacts 5 which project downwardly beyond the end wall 3 and are removable from but normally strongly held by female contacts or sockets 5*a* (shown in FIG. 5) which are installed in the vehicle and form part of the flasher system 50.

The housing 1–3 contains a ferromagnetic carrier here shown as an iron plate 6 whose upper side supports a tiltable activating element 7. The element 7 resembles the frustum of a cone and consists primarily of a suitable synthetic plastic material. The base of the actuating element 7 is adjacent to the upper side of the iron plate 6 and carries a permanent magnet 8 which is recessed into the underside of the activating element. The iron plate 6 overlies an insulating plate 9 which consists of diamagnetic material and is adjacent to the upper side of a second iron plate 10. The plates 9 and 10 have registering central openings 11 for the upper end portion of an annular plunger 12 affixed to and surrounding a tube 13. The lower end portion of the tube 13 is connected to a helical restoring spring 14 which is attached to a plate-like insulating support 18.

The plunger 12 is surrounded by the spool 16 for an operating coil 15. The annular core of the spool 16 further surrounds a tubular guide 17 for the tube 13. The lower portion of the guide 17 has a radially outwardly extending flange 19 which is connected with the spool 16 for the coil 15. The upper end face 40 of the spool 16 is adjacent to the iron plate 10, and the lower end face 41 of the spool 16 is adjacent to but spaced from the insulating support 18. The latter is coaxial with the spool 16.

Figure 4:
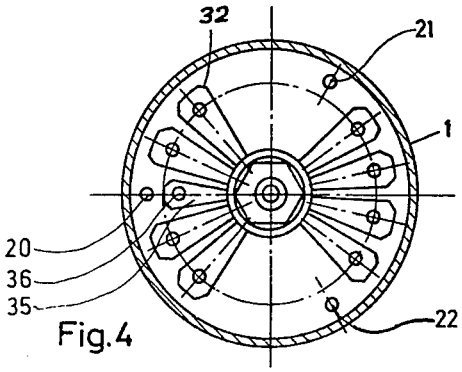
FIG. 4 is a transverse sectional view as seen in the direction of arrows from the line IV-IV of FIG. 1.

The just described parts in the interior of the housing 1–3 are held in the illustrated positions by elongated fastening elements or rods 10, 21, 22 (see also FIG. 4) which are adjacent to the inner side of the shell 1 and carry distancing sleeves including those shown at 23 and 24. The ends of the rods 20–22 are connected to the end wall 2 by screws 25 and to the end wall 3 by screws 38. Unless otherwise stated, the parts in the interior of the housing 1–3 are coaxial to each other and to the shell 1, i.e., the axis 4 is common to all such parts.

The activating element 7 abuts against an elongated post- or pin-shaped closing member or trip 26 which extends through the axial channel 27 of the tube 13 and through a central opening 28 of the insulating support 18 to abut against and to be biased upwardly by the elastic tongue or movable contact 29 of a normally open switch 30 mounted at the underside of the support 18. When the activating device of FIG. 1 is subjected to a shock, e.g., in response to sudden application of brakes, the inertia of the activating element 7 overcomes the magnetic attraction between the iron plate 6 and the permanent magnet 8, i.e., the element 7 is tilted and allows the trip 26 to move upwardly under the bias of the elastic tongue 29 so that the switch 30 closes for a short interval of time. The tongue 29 then engages the fixed contact 31 of the switch 30. The activating element 7 thereupon reassumes the illustrated position due to magnetic attaction between the plate 6 and magnet 8.

Figure 5:
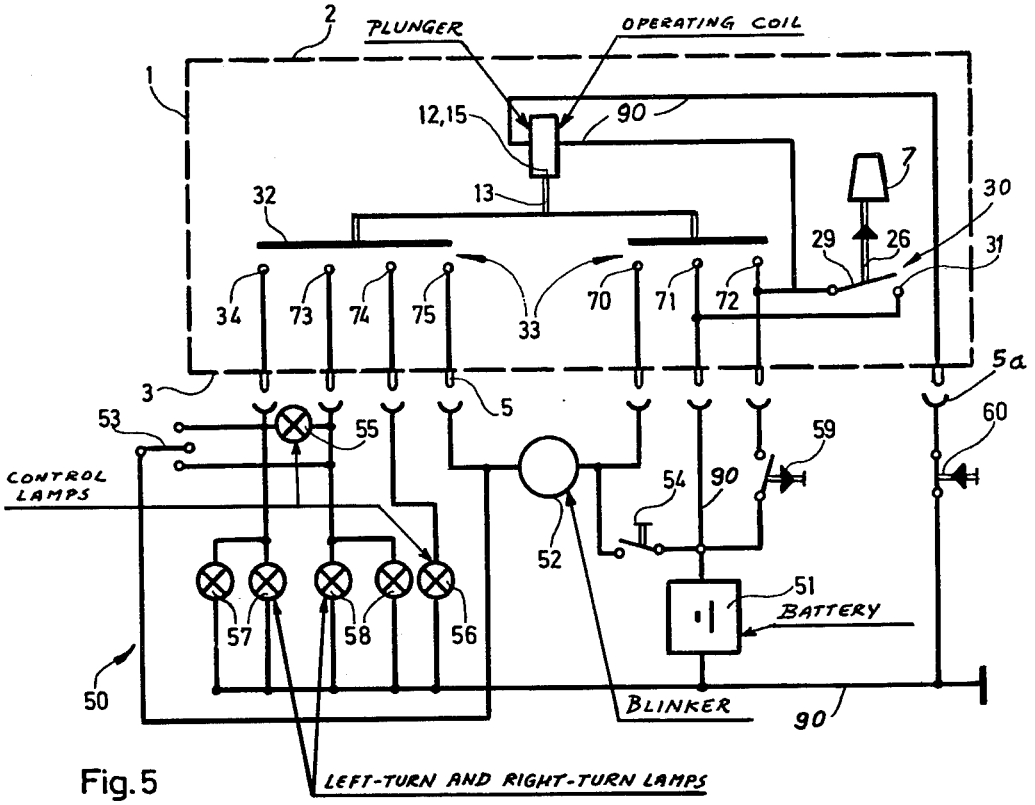
FIG. 5 is a circuit diagram of the activating device and of the associated flasher system.

The short-lasting closing of switch 30 results in completion of the circuit of the coil 15 which causes the plunger 12 to move downwardly whereby the lower end portion of the tube 13 (which is connected with the plunger) displaces the movable contacts 32 of a multi-pole switch 33 so that the contacts 32 engage the aligned fixed contacts 34 and 70–75 best shown in FIG. 5. The fixed contacts 34 and 70–75 are secured to the insulating support 18 and are connected with the aforementioned male contacts 5 and female contacts 5*a*. The contacts 5*a* form part of a circuit which is shown in the lower part of FIG. 5 and constitutes the flasher system 50. The contacts 32 are connected to the tube 13.

The lower end portion of the tube 13 carries a radially extending tongue 35 (FIG. 4) having a hole 36 for a fixed guide pin 37 (FIG. 1) which is mounted on the insulating support 18 and is parallel to the axis 4. The purpose of the parts 35–37 is to insure that the movable contacts 32 of the multi-pole switch 33 are properly oriented with respect to the stationary contacts 34, 70–75 and that such orientation remains unchanged when the activating device is in use.

The flasher system 50 of FIG. 5 is mounted in the vehicle and comprises a battery 51 or an analogous energy source, a customary blinker 52, a two-position switch 53 which is actuated by the operator of the vehicle by way of the customary turn indicator lever (not shown), an ignition switch 54, a control lamp 55 for the switch 53, a control lamp 56 for the entire flasher system 50, left-turn lamps 57, right-turn lamps 58, a noramally open manually operable switch 59 for activation of the emergency flasher system 50, and a normally closed deactivating switch 60 which can be opened by hand to open the circuit of the system 50. The switch 59 is connected in parallel with the switch 30 and is closed by the operator of the vehicle when the flasher system 50 is to be turned on independently of the switch 30, i.e., in non-emergency situations. The switch 60 is opened by the operator or by another person when the entire system is to be turned off.

The reference character 91 denotes a strap which secures the housing 1–3 to the frame of the automotive vehicle.

When the operator wishes to make a turn or to change lanes, the switch 53 is actuated by hand in the customary way whereby the switch 53 completes the circuit of the lamps 57 or 58, and the control lamp 55 on the dashboard lights up to indicate that the selected turn lamp is on. The lever which actuates the switch 53 is also movable to a neutral position in which the movable contact of the switch 53 assumes the position shown in FIG. 5, i.e., the lamps 55, 57 and 58 are off. The lamps 57 and 58 are in circuit with the blinker 52 so that visible signals furnished by the lamps 57 or 58 are transmitted in the form of flashes.

If the emergency flasher system 50 is to be activated by the operator, the operator closes the switch 59 for a short interval of time. As mentioned above, the switch 59 is connected in parallel with the switch 30 so that the closing of switch 59 results in energization of the coil 15 and closing of the switch 33. The movable contacts 32 engage the fixed contacts 70, 71 and 72 of the switch 33 and thus complete a holding circuit 90 for the coil 15, i.e., the coil remains energized after opening of the switch 59. Moreover, the ignition switch 54 is bypassed so that the energy source 51 is in circuit with the blinker 52. The movable contacts 32 further engage the contacts 34, 73, 74 and 75 of the switch 33 to thus complete the circuit of the lamps 56, 57 and 58 regardless of the position of movable contact of the switch 53. Therefore, the lamps 56, 57, 58 flash and warn the oncoming drivers as well as the drivers behind the vehicle to pay special attention to the vehicle.

In order to deactivate the emergency flasher system 50, the driver must open the switch 60 to thus deenergize the coil of the relay 12, 13, 15, 16. This opens the holding circuit 90 for the coil 15 and the switch 33 can open, i.e., the system 50 reassumes the quiescent condition of FIG. 5.

In the event of an emergency (e.g., in the course of an accident or in response to sudden application of brakes), the activating element 7 closes the switch 30 in the aforedescribed manner whereby the switch 30 completes the circuit of the coil 15 which causes the composite plunger means 12, 13 of the relay 12, 13, 15, 16 to close the switch 33, i.e., the emergency flasher system 50 is on without manual closing of the switch 59. The system 50 remains on until the driver or another person opens the switch 60 to deenergize the holding circuit 90 for the coil 15.

An important advantage for the activating device including the parts in the housing 1–3 is that it can be readily combined with existing flasher systems. Moreover, the circuit of the activating device is simple and compact, and the attachment of such device to the flasher system does not prevent the operator from activating the flasher system by hand (via switch 59). The device is rugged and can be readily adjusted to respond to shocks (speed changes) of selected magnitude. The relay 12, 13, 15, 16 insures that the flasher system 50 is energized and remains on in response to a short-lasting change in the position of activating element 7, and that no resetting is necessary in order to prepare the device for the next operation (save, of course, for deenergization of the holding circuit 90 by opening the switch 60).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. The combination of an emergency flasher system which is installed in an automotive vehicle and comprises electric circuit means arranged to furnish a series of signals in response to completion thereof, with a shock responsive activating device including a housing which constitutes an upright cylinder and is secured to the vehicle, a normally open circuit-completing first switch in said housing, an iron plate in said housing, a tiltable activating element disposed at one side of said plate and including a permanent magnet which normally adheres to said plate but permits temporary tilting of said activating element in response to the application of a shock of predetermined magnitude, a normally open second switch in said housing, a relay installed in said housing and including a coil in circuit with said second switch so that said coil is energized on closing of said second switch and a plunger displaceable on energization of said coil to thereby close said first switch and complete said circuit means, said relay further including a spool for said coil, said spool being adjacent to the other side of said plate, movable means for closing said second switch in response to tilting of said activating element to thereby energize said coil, said plate having a central opening for said closing means and said spool also having a central opening for said closing means, a holding circuit for said relay, said first switch including means for completing said holding circuit on closing of said first switch by said plunger, and means for biasing said plunger to a position in which said plunger permits said first switch to open when said coil is deenergized, said spool being disposed between said plate and said first switch and said plunger including a tubular member through which said closing means extends.

2. The combination of claim 1, wherein said closing means is an elongated post which is reciprocable in said housing and further comprising an insulating support provided in said housing at that side of said spool which is remote from said iron plate, said first switch having a plurality of first contacts secured to said support and a plurality of second contacts secured to said plunger.

3. The combination of claim 2, wherein said second switch includes a first contact secured to said support and a second contact also secured to said support and located in the path of movement of said post to engage said last mentioned first contact on movement of said post as a result of tilting of said activating element.

4. The combination of claim 3, wherein said support has an opening for said post.

5. The combination of claim 1, further comprising a second iron plate surrounding said plunger intermediate said spool and insulator means interposed between said iron plates, said second iron plate and said insulator means having openings into which said plunger extends in deenergized condition of said coil.

6. The combination of claim 1, further comprising means for fastening said carrier and said spool to said housing.

7. The combination of claim 1, further comprising a normally open manually operable switch connected in parallel with said second switch.

8. The combination of claim 1, further comprising manually operable means for deenergizing said coil.

9. The combination of claim 1, further comprising separable male and female contact means for connecting said first switch with said circuit means.

* * * * *